US008641475B1

(12) United States Patent
Hung-Ming

(10) Patent No.: US 8,641,475 B1
(45) Date of Patent: Feb. 4, 2014

(54) BRA CUP WITH AN AIR BAG

(71) Applicant: Cheng Hung-Ming, Hsinchu (TW)

(72) Inventor: Cheng Hung-Ming, Hsinchu (TW)

( * ) Notice: Subject to any disclaimer, the term of this patent is extended or adjusted under 35 U.S.C. 154(b) by 0 days.

(21) Appl. No.: 13/621,868

(22) Filed: Sep. 18, 2012

(51) Int. Cl.
*A41C 3/00* (2006.01)

(52) U.S. Cl.
USPC ..... 450/38; 450/54; 450/57

(58) Field of Classification Search
USPC ..... 450/38, 54–57, 39; 2/267, 268, DIG. 3, 2/67, 69
See application file for complete search history.

(56) References Cited

U.S. PATENT DOCUMENTS 3,326,218 A * 6/1967 McAlpine ..... 450/38
5,347,656 A * 9/1994 Fabritz et al. ..... 2/67
5,697,974 A * 12/1997 Wang ..... 623/7
5,833,515 A * 11/1998 Shahbazian et al. ..... 450/38
6,080,037 A * 6/2000 Lee et al. ..... 450/38
6,302,760 B1 * 10/2001 Dai ..... 450/38
6,354,906 B1 * 3/2002 Liu ..... 450/38
6,461,221 B1 * 10/2002 Stilwell et al. ..... 450/57
6,811,463 B2 * 11/2004 Martz ..... 450/57
7,442,727 B2 * 10/2008 Meyer et al. ..... 523/212
8,251,772 B2 * 8/2012 Lin ..... 450/39

* cited by examiner

*Primary Examiner* — Gloria Hale
(74) *Attorney, Agent, or Firm* — Alan Kamrath; Kamrath IP Lawfirm P.A.

(57) ABSTRACT

A bra cup with an air bag contains a body including an inner cup portion and an outer cup portion hot pressed together. The inner cup portion has a first elastic layer having a first connecting face for connecting with the outer cup portion. The inner cup portion also has an inner layer hot embossed and connected with the first elastic layer. The outer cup portion has a second elastic layer having a second connecting face for connecting with the inner cup portion. The outer cup portion also has an outer layer hot embossed and connected with the second elastic layer. At least one screen adhesive is connected between the inner cup portion and the outer cup portion of the body. An air bag is connected between the inner cup portion and the outer cup portion of the body.

11 Claims, 8 Drawing Sheets

BRA CUP WITH AN AIR BAG

BACKGROUND OF THE INVENTION

1. Field of the Invention

The present invention relates to a bra cup and more particularly, to a bra cup with an air bag.

2. Description of the Prior Art

A conventional bra has two bra cups connected with a bra body and two back straps. Each back strap has a fastener and a hook to match with the fastener, and between a top rim of each bra cup is defined a shoulder strap. Thereby, the bra allows covering female's breasts to prevent sagging breasts and to enhance wearing appearance.

To beautify the wearing appearance, the bra cup is provided with a pad to support the breast upwardly to obtain a perfect visual appearance. The pad is made of silica gel, foam, an air bag, or a water bag. The air bag is light, flexible, shaping sexual and popular by users.

However, such a pad with the air bag is expanded by heat easily to cause a burst. Accordingly, the air bag can not be defined in the bra cup when hot embossing the bra cup. Typically, the bra cup has a receiving cavity to receive the air bag, but such a receiving cavity will produce an uneven cup bra and wearing discomfort. In addition, the air bag can not be fixed in the receiving cavity securely, thus moving or falling easily and resulting in using inconvenience.

The present invention has arisen to mitigate and/or obviate the afore-described disadvantages.

SUMMARY OF THE INVENTION

The primary object of the present invention is to provide a bra cup with an air bag which allows defining an air bag between an inner cup portion and an outer cup portion of the body securely.

Another object of the present invention is to provide a bra cup with an air bag which is capable of obtaining aesthetics appearance and using convenience.

A bra cup with an air bag in accordance with the present invention contains a body including an inner cup portion and an outer cup portion, both of which are hot pressed together. The inner cup portion has a first elastic layer having a first connecting face for connecting with the outer cup portion. The inner cup portion also has an inner layer hot embossed and connected with the first elastic layer. The outer cup portion has a second elastic layer having a second connecting face for connecting with the inner cup portion. The outer cup portion also has an outer layer hot embossed and connected with the second elastic layer. At least one adhesive is connected between the inner cup portion and the outer cup portion of the body. An air bag is connected between the inner cup portion and the outer cup portion of the body.

The first elastic layer of the inner cup portion is made of elastic fiber cotton.

The first elastic layer of the inner cup portion is made of Polyurethane (PU) foam.

The second elastic layer of the outer cup portion is made of elastic fiber cotton.

The second elastic layer of the outer cup portion is made of Polyurethane (PU) foam.

The inner layer of the inner cup portion of the body includes two first surface cloths between which a first fiber having a flexibility is defined.

The inner layer of the inner cup portion of the body includes a first surface cloth, and an inner surface of the first surface cloth connects with a first fiber having a flexibility.

The inner cup portion of the body has a first surface cloth.

The outer layer of the outer cup portion of the body includes two second surface cloths between which a second fiber having a flexibility is defined.

The outer layer of the outer cup portion of the body includes a second surface cloth, with an inner surface of the second surface cloth coupling with a second fiber having a flexibility.

The outer cup portion of the body has a second surface cloth.

DETAILED DESCRIPTION OF THE PREFERRED EMBODIMENTS

Figure 1:
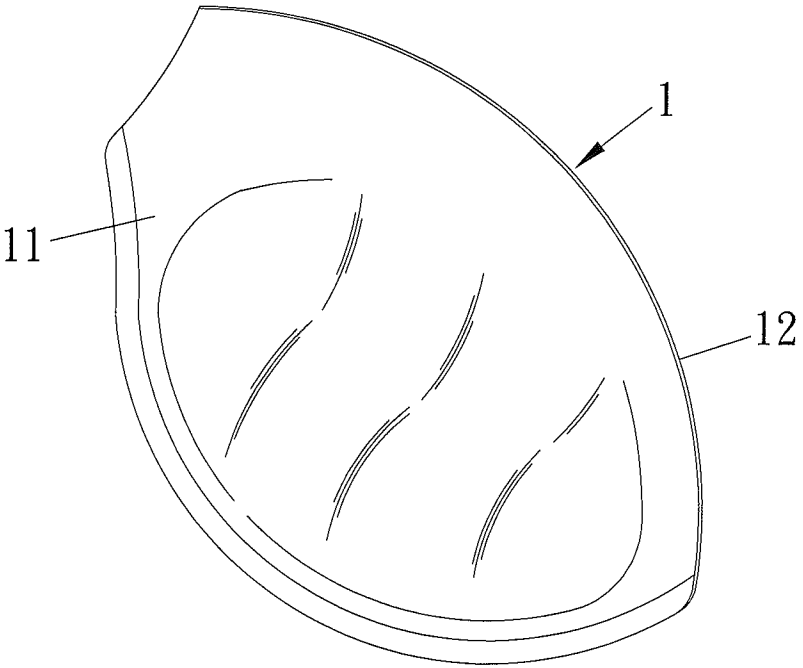
FIG. 1 is a perspective view showing the assembly of a bra cup with an air bag according to a first embodiment of the present invention.
Figure 2:
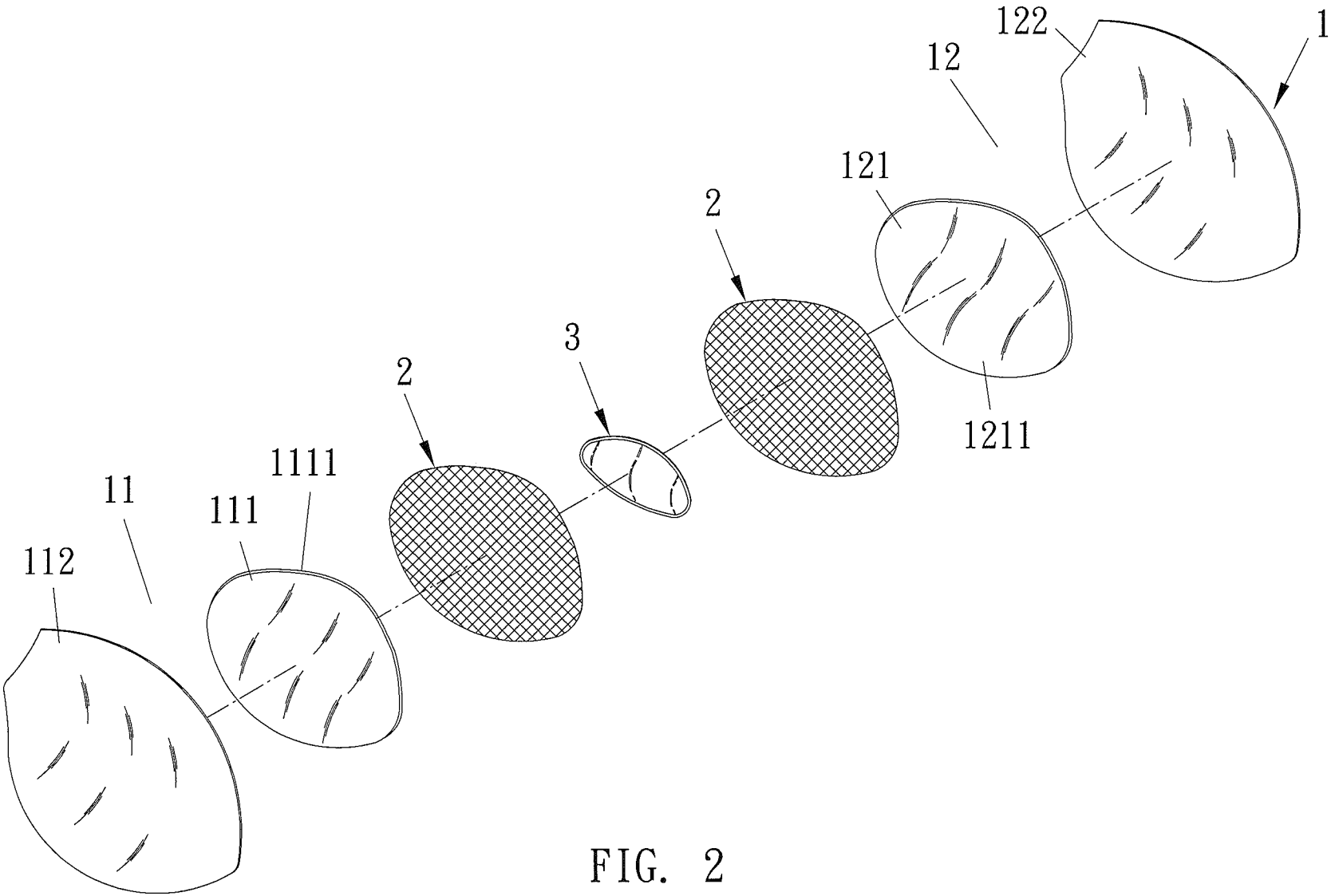
FIG. 2 is a perspective view showing the exploded components of the bra cup with the air bag according to the first embodiment of the present invention.
Figure 3:
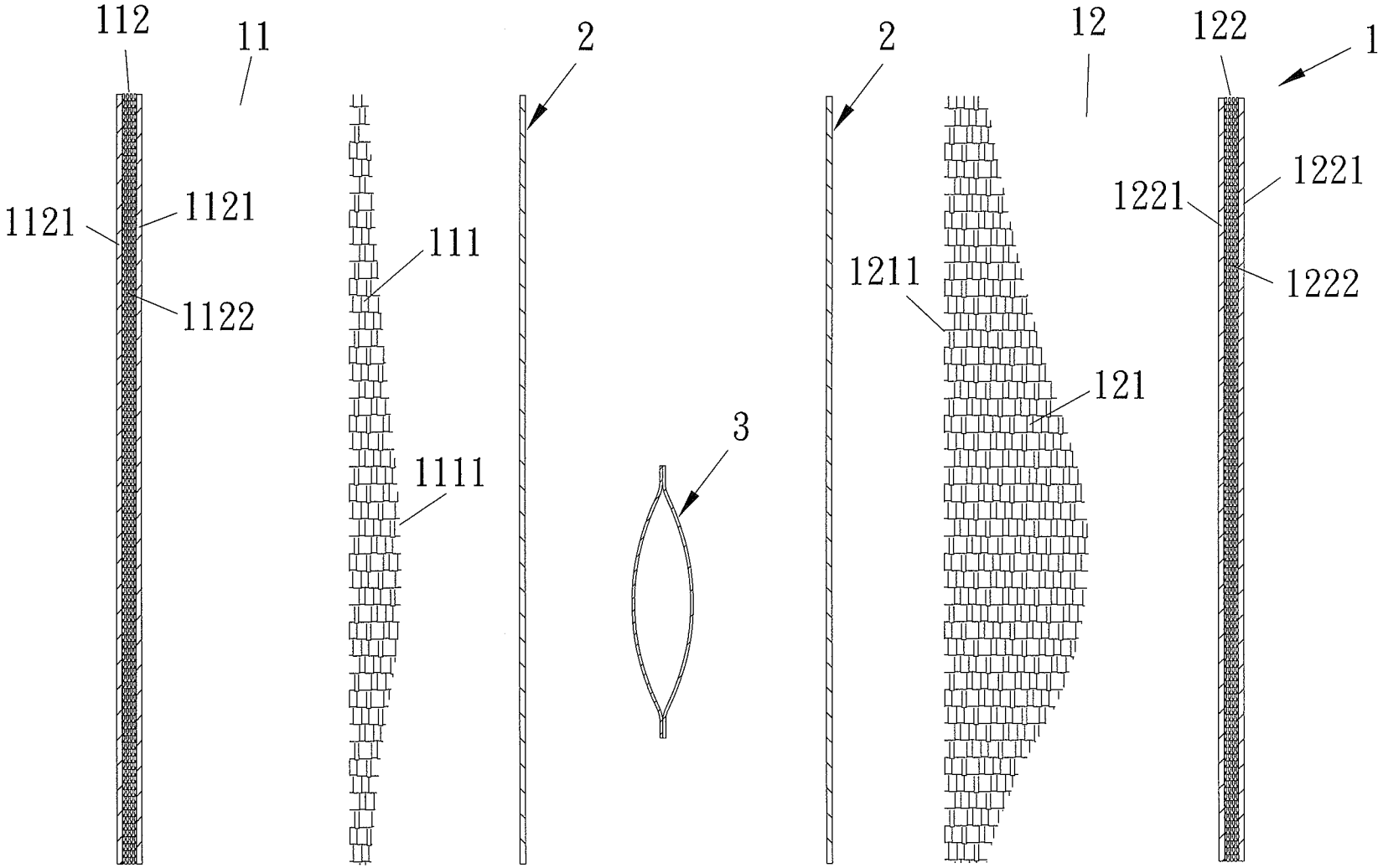
FIG. 3 is a cross sectional view showing the exploded components of the bra cup with the air bag according to the first embodiment of the present invention.
Figure 4:
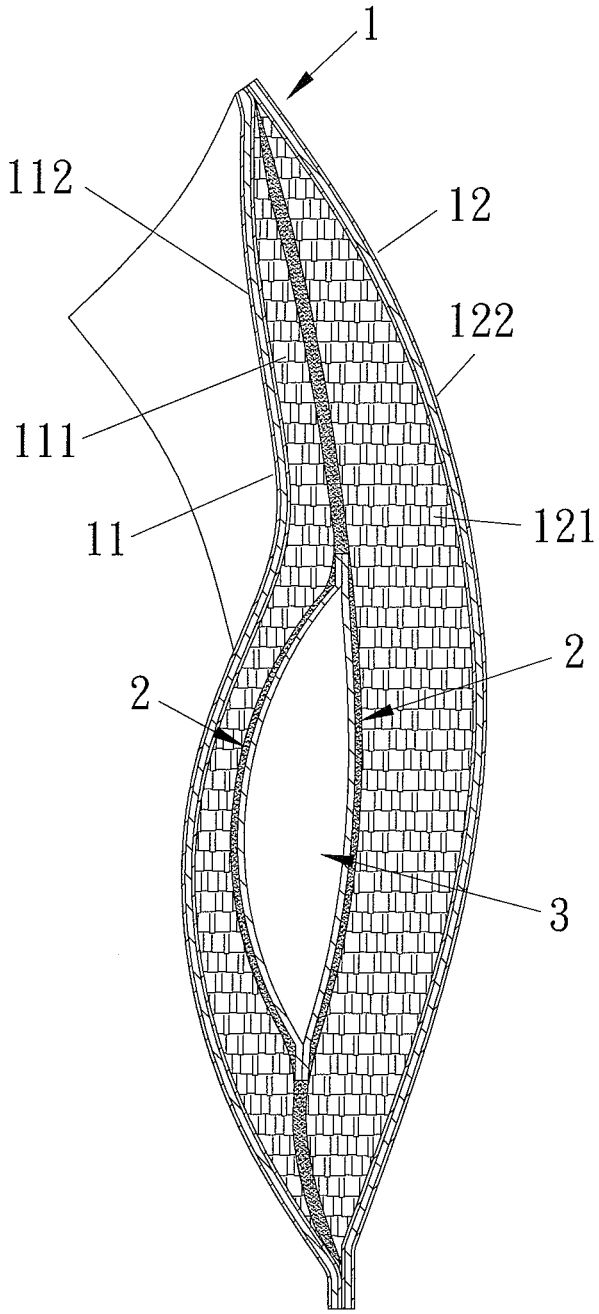
FIG. 4 is a cross sectional view showing the assembly of the bra cup with the air bag according to the first embodiment of the present invention.

The present invention will be clearer from the following description when viewed together with the accompanying drawings, which show, for purpose of illustration only, the preferred embodiments in accordance with the present invention.

Referring to FIGS. 1-4, a bra cup with an air bag according to a first embodiment of the present invention comprises a body 1 including an inner cup portion 11 and an outer cup portion 12, both of which are hot pressed together. The inner cup portion 11 has a first elastic layer 111 made of high elastic fiber cotton or Polyurethane (PU) foam. The first elastic layer 111 has a first connecting face 1111 for connecting with the outer cup portion 12. The inner cup portion 11 also has an inner layer 112 hot embossed and connected with the first elastic layer 111. The inner layer 112 includes two first surface cloths 1121 between which a first fiber 1122 having a high flexibility is defined. The outer cup portion 12 has a second elastic layer 121 made of high elastic fiber cotton or Polyurethane (PU) foam, and the second elastic layer 121 has a second connecting face 1211 for connecting with the inner cup portion 11. The outer cup portion 12 also having has an outer layer 122 hot embossed and connected with the second elastic layer 121. The outer layer 122 includes two second surface cloths 1221 between which a second fiber 1222 having a high flexibility is defined.

Two screen adhesives 2 are defined between the first connecting face 1111 of the inner cup portion 11 of the body 1 and the second connecting face 1211 of the outer cup portion 12 of the body 1 and have an adhesion force after being heated to adhere the first connecting face 111 of the inner cup portion 11 with the second connecting face 1211 of the outer cup portion 12.

An air bag 3 is made of a plastic film in which air is sealed, and the air bag 3 is connected between the inner cup portion 11 and the outer cup portion 12 of the body 1.

In production, the inner cup portion 11 and the outer cup portion 12 are hot embossed into a cup shape. Then, the two screen adhesives 2 and the air bag 3 are placed between the first connecting face 1111 of the inner cup portion 11 and the second connecting face 1211 of the outer cup portion 12. The two screen adhesives 2 are connected with two sides of the air bag 3 and with the inner cup portion 11 and the outer cup portion 12 of the body 1 in a hot embossing manner. Hence, the air bag 3 is coupled between the inner cup portion 11 and the outer cup portion 12 of the body 1. Since the inner cup portion 11 and the outer cup portion 12 are hot embossed in advance and have the first elastic layer 111 and the second elastic layer 121, both of which are made of the high elastic fiber cotton or the Polyurethane (PU) foam, the body 1 is hot embossed from the inner cup portion 11 and the outer cup portion 12 at a lower temperature by way of a thermal insulation of the first elastic layer 111 and the second elastic layer 121 and an adhesion of the two screen adhesives 2, thus preventing the air bag 3 from bursting because of thermal expansion.

Figure 5:
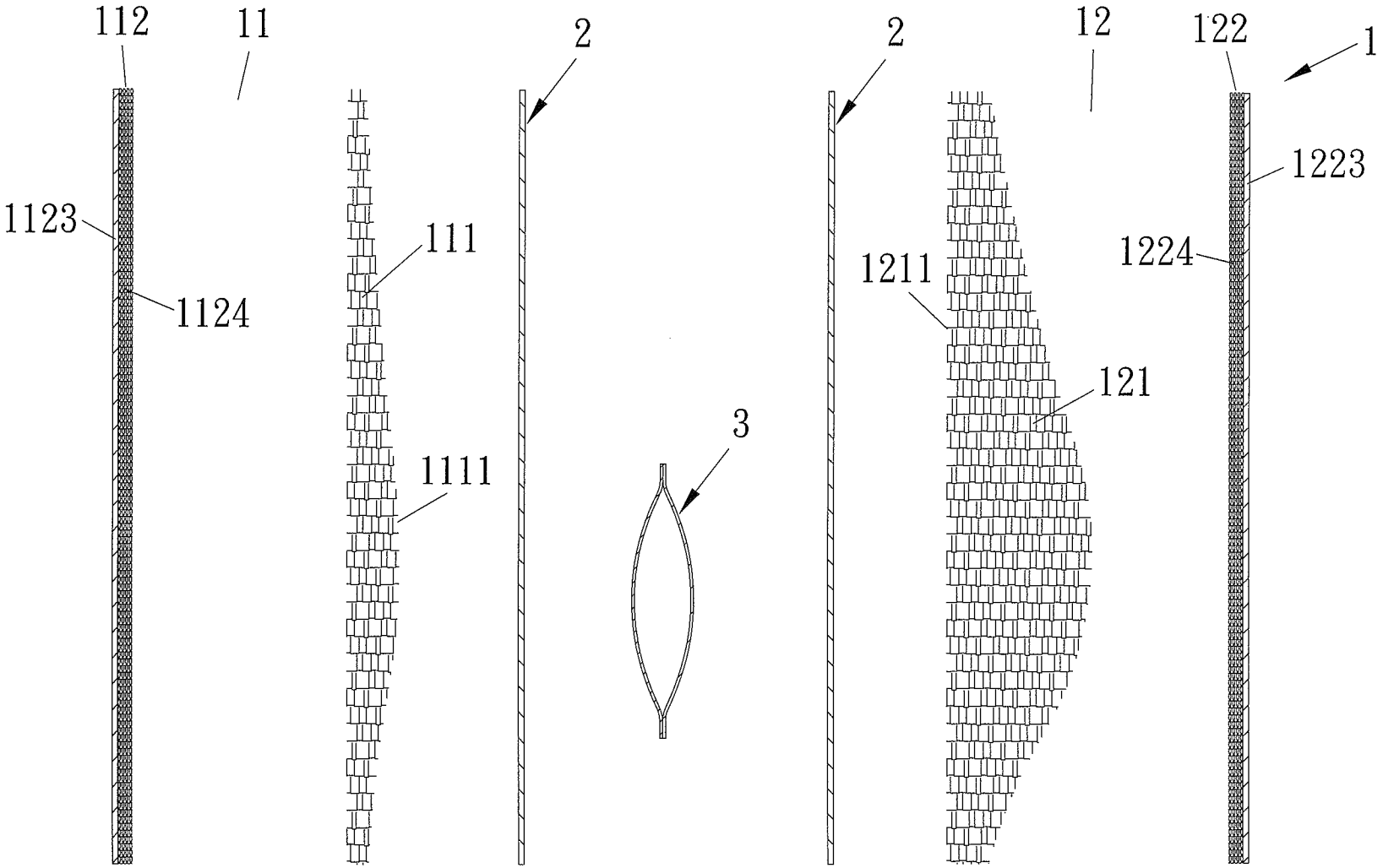
FIG. 5 is a cross sectional view showing the exploded components of a bra cup with an air bag according to a second embodiment of the present invention.

Referring further to FIG. 5, a difference of a bra cup with an air bag according to a second embodiment of the present invention from that of the first embodiment comprises an inner cup portion 11 with an inner layer 112 and an outer cup portion 12 with an outer layer 122. The inner layer 112 includes a first surface cloth 1123. The outer layer 122 includes a second surface cloth 1223. An inner surface of the first surface cloth 1123 connects with a first fiber 1124 having a high flexibility, and an inner surface of the second surface cloth 1223 couples with a second fiber 1224 having a high flexibility.

Figure 6:
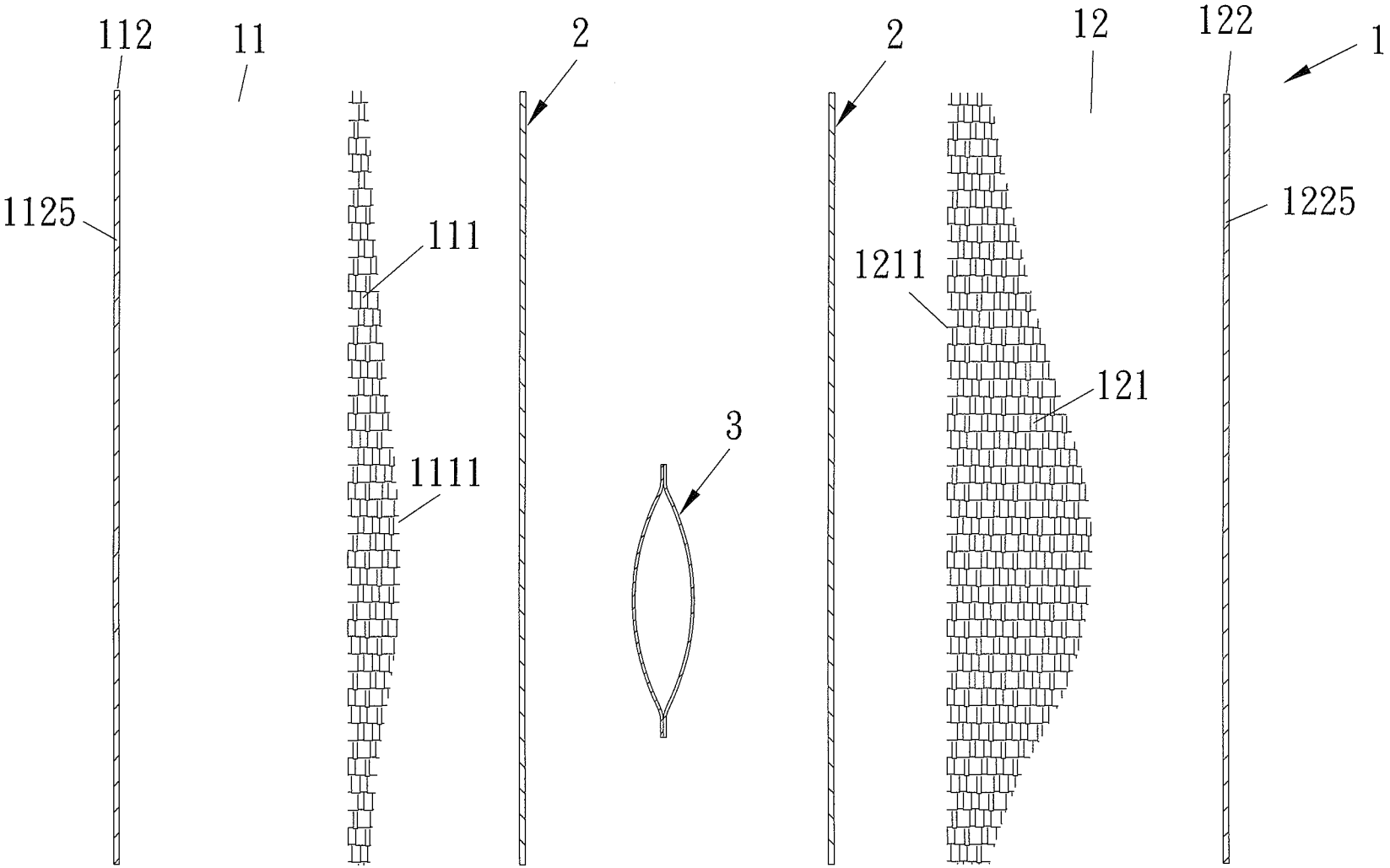
FIG. 6 is a cross sectional view showing the exploded components of a bra cup with an air bag according to a third embodiment of the present invention.

As shown in FIG. 6, a difference of a bra cup with an air bag according to a third embodiment of the present invention from that of the first embodiment comprises an inner cup portion 11 having a first surface cloth 1125 and an outer cup portion 12 having a second surface cloth 1225.

Figure 7:
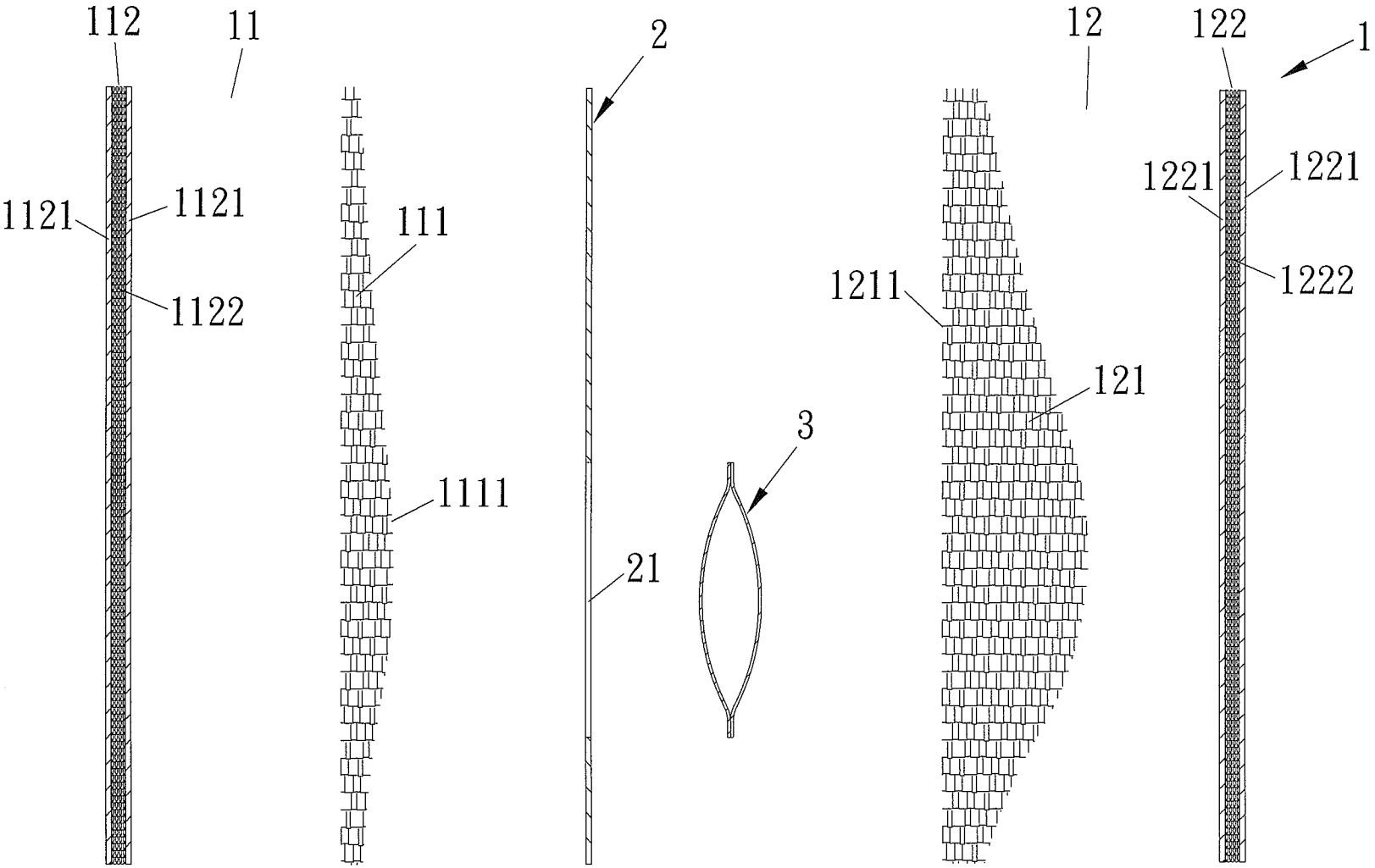
FIG. 7 is a cross sectional view showing the exploded components of a bra cup with an air bag according to a fourth embodiment of the present invention.
Figure 8:
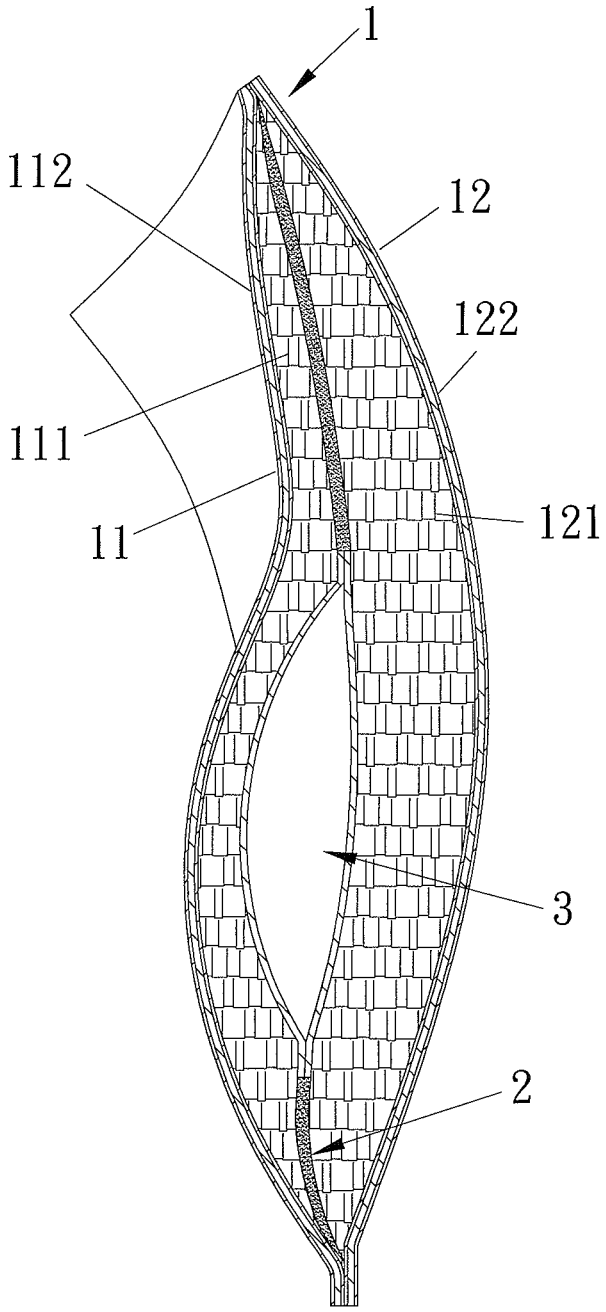
FIG. 8 is a cross sectional view showing the assembly of a bra cup with an air bag according to the fourth embodiment of the present invention.

With reference with FIGS. 7 and 8, a difference of a bra cup with an air bag according to a fourth embodiment of the present invention from that of the first embodiment comprises a screen adhesive 2 in which a through hole 21 is defined to insert the air bag 3.

Thereby, the bra cup with the air bag allows defining the air bag 3 between the inner cup portion 11 and the outer cup portion 12 of the body 1 securely. In addition, aesthetics appearance and using convenience are achieved as well.

While various embodiments in accordance with the present invention have been shown and described, it is clear to those skilled in the art that further embodiments may be made without departing from the scope of the present invention.

What is claimed is:

1. A bra cup with an air bag comprising:

a body including an inner cup portion and an outer cup portion, both of which are hot pressed together, with the inner cup portion having a first elastic layer having a first connecting face for connecting with the outer cup portion, with the inner cup portion also having an inner layer hot embossed and connected with the first elastic layer, with the outer cup portion having a second elastic layer having a second connecting face for connecting with the inner cup portion, with the outer cup portion also having an outer layer hot embossed and connected with the second elastic layer;

at least one adhesive connected between the inner cup portion and the outer cup portion of the body; and an air bag connected between the inner cup portion and the outer cup portion of the body.

2. The bra cup with the air bag as claimed in claim 1, wherein the first elastic layer of the inner cup portion is made of elastic fiber cotton.

3. The bra cup with the air bag as claimed in claim 1, wherein the first elastic layer of the inner cup portion is made of Polyurethane foam.

4. The bra cup with the air bag as claimed in claim 1, wherein the second elastic layer of the outer cup portion is made of elastic fiber cotton.

5. The bra cup with the air bag as claimed in claim 1, wherein the second elastic layer of the outer cup portion is made of Polyurethane foam.

6. The bra cup with the air bag as claimed in claim 1, wherein the inner layer of the inner cup portion of the body includes two first surface cloths between which a first fiber having a flexibility is defined.

7. The bra cup with the air bag as claimed in claim 1, wherein the inner layer of the inner cup portion of the body includes a first surface cloth, and wherein an inner surface of the first surface cloth connects with a first fiber having a flexibility.

8. The bra cup with the air bag as claimed in claim 1, wherein the inner cup portion of the body has a first surface cloth.

9. The bra cup with the air bag as claimed in claim 1, wherein the outer layer of the outer cup portion of the body includes two second surface cloths between which a second fiber having a flexibility is defined.

10. The bra cup with the air bag as claimed in claim 1, wherein the outer layer of the outer cup portion of the body includes a second surface cloth, and wherein an inner surface of the second surface cloth couples with a second fiber having a flexibility.

11. The bra cup with the air bag as claimed in claim 1, wherein the outer cup portion of the body has a second surface cloth.

* * * * *